United States Patent [19]

Sievers

[11] Patent Number: 4,599,773

[45] Date of Patent: Jul. 15, 1986

[54] METHOD OF FORMING A MULTIPLE COIL HEAT EXCHANGER

[75] Inventor: Richard W. Sievers, South Windsor, Conn.

[73] Assignee: Thermodynetics Inc., Windsor, Conn.

[21] Appl. No.: 420,599

[22] Filed: Sep. 20, 1982

Related U.S. Application Data

[60] Division of Ser. No. 141,894, Apr. 21, 1982, abandoned, which is a continuation-in-part of Ser. No. 83,568, Oct. 11, 1979, abandoned.

[51] Int. Cl.[4] ..... B23P 15/26

[52] U.S. Cl. ..... 29/157.3 R; 29/727

[58] Field of Search ..... 165/156, 164, 169, 168, 165/163, 151, 182, 177, 184; 29/727, 726, 157.3 R, 157.4, 157.3 D, 157.3 AH, 157.3 A, 157.3 B, 157.3 C, 402.02, 402.08; 72/135, 143, 371, 369, 176, 180; 242/7.21, 7.22

[56] References Cited

U.S. PATENT DOCUMENTS

| | | | |
|---|---|---|---|
| 1,799,081 | 3/1931 | Blomqvist | 165/164 |
| 1,802,161 | 4/1931 | Summers | 29/727 |
| 1,993,171 | 3/1935 | Hyde | 29/157.3 AH |
| 3,335,790 | 8/1967 | Aranyi et al. | 165/163 |
| 4,195,653 | 4/1980 | Cessou | 137/15 |
| 4,424,624 | 1/1984 | Sievers | 29/727 |

FOREIGN PATENT DOCUMENTS

| | | | |
|---|---|---|---|
| 1146160 | 5/1983 | Canada | 29/157.3 AH |
| 10818 | 5/1980 | European Pat. Off. | 165/156 |

*Primary Examiner*—Howard N. Goldberg
*Assistant Examiner*—P. W. Echols
*Attorney, Agent, or Firm*—Amster, Rothstein & Ebenstein

[57] ABSTRACT

A compact multiple coil heat exchanger having a high heat transfer density is provided to include at least an inner coil formed from a continuous tube into a plurality of contiguous turns about a common axis in a spiral arrangement and having a pitch in one direction and an outer coil formed from the continuous tube into a plurality of overlapping turns concentrically about the inner coil in a spiral arrangement having an opposite pitch. Further, a coil-forming apparatus and continuous coil-forming method is directed to form a multiple coil heat exchanger from a continuous tube using a coil-forming die rotatably mounted on a support frame. The coil-forming die includes a continuous spiral thread constructed to receive and laterally support the continuous tube while fabricating the multiple coil heat exchanger according to the continuous coil-forming method of this invention. The thread of the coil-forming die terminates at one end thereof at a coil-reversing plate having a first portion which spirals outward to a radial position above the thread and a second portion which axially extends towards the opposite end of the coil-forming die to form a one-piece multiple coil heat exchanger.

1 Claim, 14 Drawing Figures

FIG. 9.
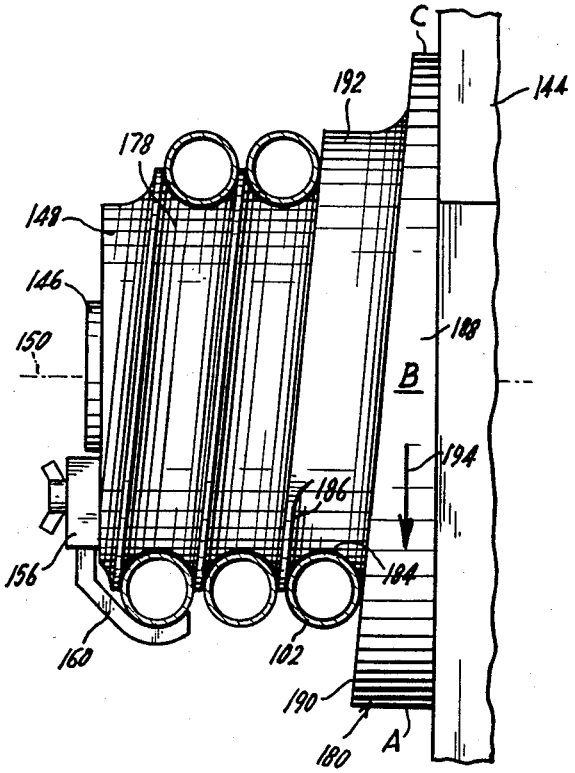
FIG. 10.
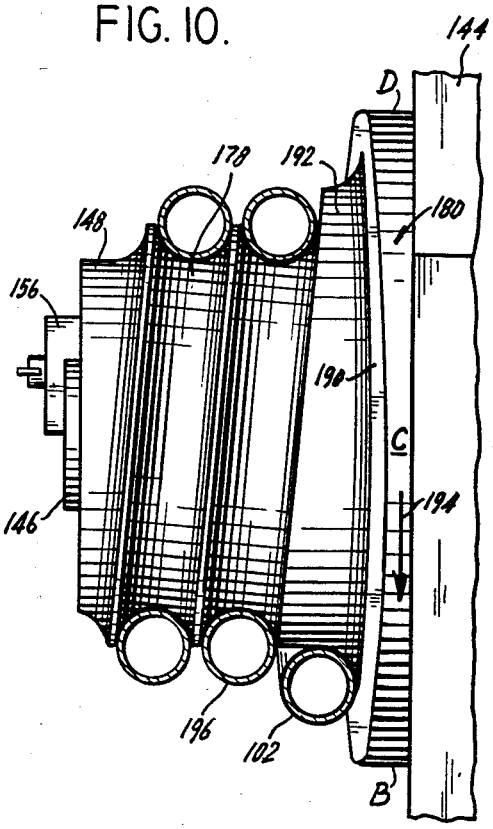
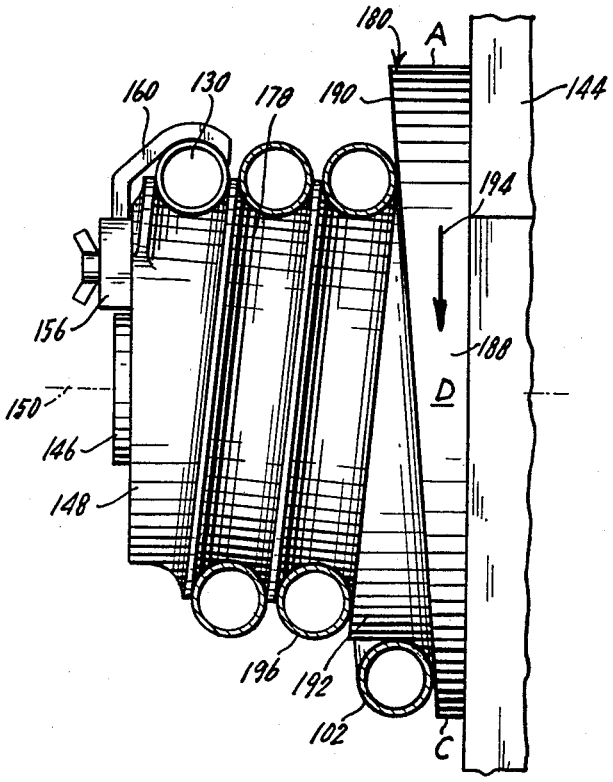
FIG. 11.

FIG. 12.
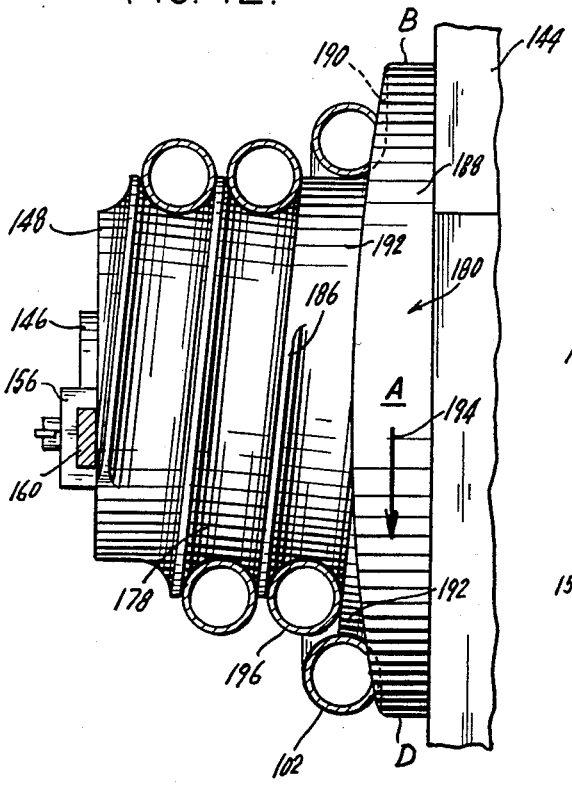
FIG. 13.
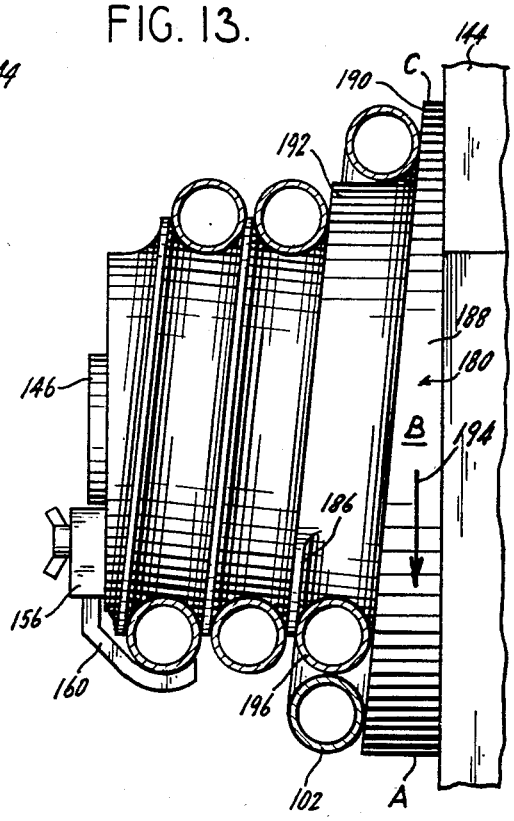
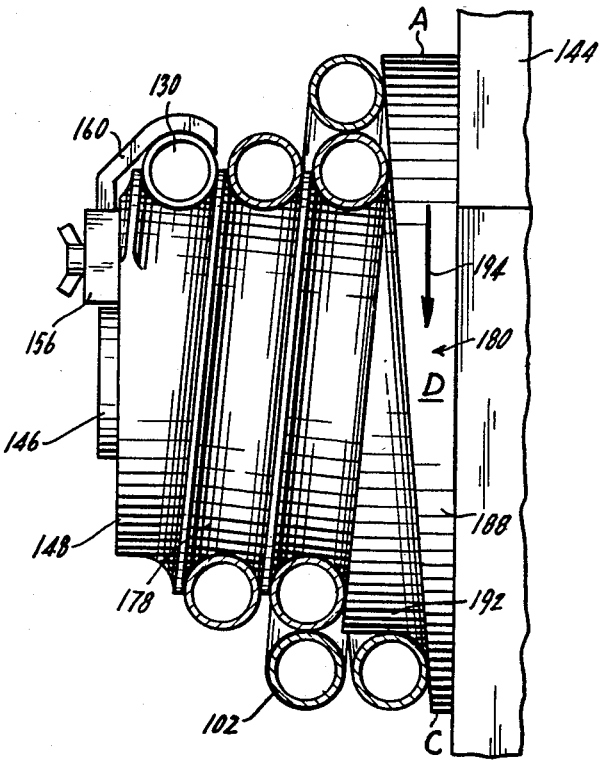
FIG. 14.

METHOD OF FORMING A MULTIPLE COIL HEAT EXCHANGER

This is a division of application Ser. No. 141,894 filed 4/21/82, now abandoned, which is a continuation-in-part of application Ser. No. 83,568, filed Oct. 11, 1979, now abandoned.

BACKGROUND OF THE INVENTION

This invention relates in general to a heat exchanger, and more particularly, to a compact multiple coil heat exchanger having an improved heat transfer density and adapted to be easily accessible for repairs and maintenance in a modern refrigeration system.

In modern refrigeration systems, the compactness of the system's components results in the advantage of reducing the overall refrigeration system size and ultimately the related manufacturing costs. In the design of a compact refrigeration system, each component must be separately designed to be as small as possible, yet fully functional to satisfy the refrigeration system requirements. One such component is a heat exchanger or condenser which is used to cool the hot compressed refrigerant gases during the operation of the refrigeration system. The heat exchanger design must be such that it occupies a minimum space while maintaining a high performance as measured in BTU's/hours/surface area.

In providing a minimum of space in the refrigeration system design for the heat exchanger, it is further required that the heat exchanger's configuration be such to facilitate its removal and/or installation as required for repairs or maintenance. Heat exchangers incorporated in current refrigeration systems usually have their inlet and outlet disposed at opposite ends of the heat exchanger. This restricted configuration requires a complicated arrangement of refrigerant and cooling connecting lines to the heat exchanger, in addition to rendering the connections relatively inaccessible for easy removal of the heat exchanger.

Accordingly, there is a need for a compact heat exchanger which occupies a minimum of space while retaining a high heat transfer density and is adapted for easy installation and connection to refrigerant cooling lines within the compact space provided in a modern refrigeration system.

SUMMARY OF THE INVENTION

It is broadly an object of this invention to provide a multiple coil heat exchanger which fulfills one or more of the foregoing requirements of modern refrigeration systems. Specifically, it is within the contemplation of this invention to provide a heat exchanger formed from a continuous tube coiled about a common axis into inner and outer concentric overlapping coils having an inlet and outlet disposed in a common plane at one end and a continuous transition segment joining the inner and outer coils at the other end thereof.

A further object of this invention is to provide a multiple coil heat exchanger constructed in a continuous coil-forming process by the uninterrupted rotation of a coil-forming die.

A still further object of this invention is to provide a multiple coil heat exchanger which is compact and has a high heat transfer density in relationship to its overall size.

A still further object of this invention is to provide a multiple coil heat exchanger that is constructed and arranged for easy installation within a compact space provided in a modern refrigeration system by having at least its inlet and outlet extending tangentially from the inner and outer coils at one common end thereof.

A still further object of this invention is to provide a coiled construction adapted to form a multiple coil heat exchanger from a continuous length of tube by a continuous coil-forming method.

A still further object of this invention is to provide a coil-forming apparatus constructed and arranged for fabricating from a continuous length of tube a heat exchanger adapted for easy installation within a modern refrigeration system while retaining a high heat transfer density.

In accordance with one illustrative embodiment of this invention, there is provided a multiple coil heat exchanger formed from a continuous coiled tube. The coiled tube is formed to include an inner coil having a plurality of contiguous turns coiled about a common axis in a spiral arrangement having a pitch in one direction and an outer coil having a plurality of contiguous turns concentric about the inner coil along the common axis in a like spiral arrangement having a pitch in the opposite direction. A continuous transition segment formed from a portion of the coiled tube continuously joins the inner and outer coils at a common end of the heat exchanger and having a first curved portion of increasing radius of curvature to radially extend the tube relative to the inner coil and a second curved portion for axially extending the tube over the inner coil in forming the outer coil.

Further, there is provided a coil-forming apparatus for fabricating a continuous length of tube into a compact multiple coil heat exchanger. The coil-forming apparatus includes a support frame for rotatably mounting a coil-forming die about its axis and having a spiral-like thread sized to receive the tube commencing at one end of the coil-forming die and terminating at a coil-reversing plate constructed at the other end of the coil-forming die. The coil-reversing plate is constructed at the other end of the coil-forming die to merge with and be a continuation of the spiral-like thread of the coil-forming die. A first portion of the coil-reversing plate spirals outward to a radial position above the radial extent of the spiral-like threads at the other end of the coil-forming die and a second portion of the coil-reversing plate axially extends away from the coil-reversing plate towards the one end of the coil-forming die.

Further, there is provided an improved method of fabricating the compact multiple coil heat exchanger according to the illustrative embodiment of this invention. A continuous method of fabricating a multiple coil heat exchanger having a high heat transfer density is disclosed which is initially started by securing one free end of the tube at a coil-starting position. In a continuous and uninterrupted process, the desired length of tube is coiled in a spiral direction about an axis to form an inner coil having adjacent turns extending in one direction away from the coil-starting position. Further, bending the tube radially outward slightly past the radial extent of the inner coil and axially towards the coil-starting position to form a transition segment and then continuously coiling the tube in a spiral direction about the inner coil in the opposite direction to form the concentric outer coil having contiguous turns overlapping the inner coil and extending toward the coil-starting position.

BRIEF DESCRIPTION OF THE DRAWINGS

The above description as well as further objects, features and advantages of the present invention will be more fully understood by reference to the following detailed description of the presently preferred, but nonetheless illustrative multiple coil heat exchanger, coil-forming apparatus and continuous coil-forming method in accordance with this invention when taken in conjunction with the accompanying drawings, wherein.

DETAILED DESCRIPTION OF THE PREFERRED EMBODIMENTS

Figure 1:
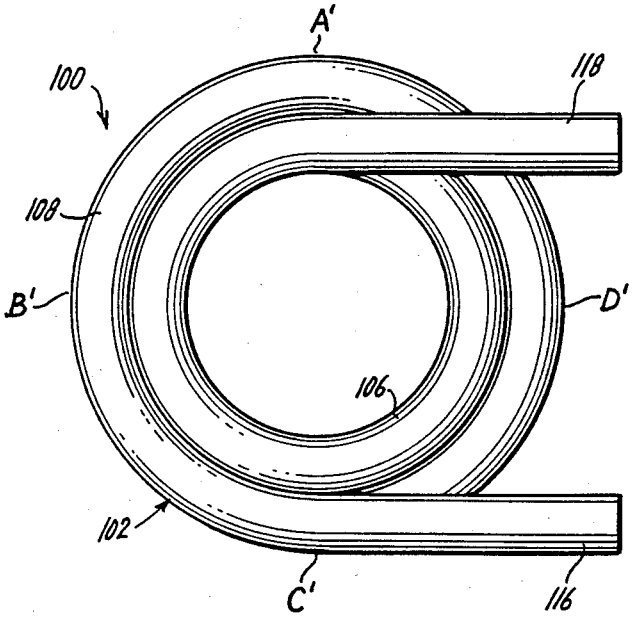
FIG. 1 is a front elevational view of a multiple coil heat exchanger constructed according to this invention and embodying concentric inner and outer coils having inlet and outlet ends extending parallel to each other in a common plane at one end of the heat exchanger to provide easy accessibility to the refrigerant and cooling line connections for ready removal of the heat exchanger from a modern refrigeration system.

There will be described according to one embodiment of this invention a compact multiple coil heat exchanger having a high heat transfer density per unit volume as shown in the illustrative embodiment of FIGS. 1–4. The multiple coil heat exchanger includes a single coiled tube formed into an inner coil of spiral-like turns about a common axis and an outer coil of like spiral-like turns overlapping the inner coil and continuously joined to the inner coil by a continuous transition segment at one end thereof. The multiple coil heat exchanger can be fabricated from a single continuous tube as shown in FIG. 1 or from a multiple concentric tube as shown in FIG. 5. The multiple concentric tube can be constructed according to U.S. Pat. No. 3,730,229, filed Mar. 11, 1971, issued May 1, 1973 and assigned to the same assignee of the present invention. One unique feature of the multiple coil heat exchanger according to this invention is that both the inlet and outlet (see FIGS. 1 and 3) may be provided at one end of the heat exchanger and further if desired, extend parallel to one another in a common plane to provide easy access to the multiple coil heat exchanger when installed in a modern refrigeration system.

Figure 6:
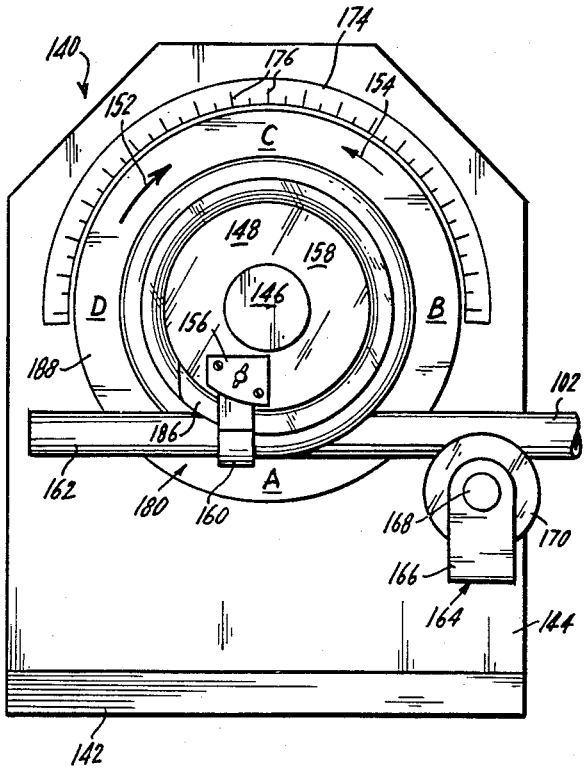
FIG. 6 is a front elevational view of a coil-forming apparatus constructed in accordance with this invention for forming a multiple coil heat exchanger according to an illustrative embodiment of this invention and having an arcuate scale for determining the relative position of the inlet and outlet with respect to each other at a common end of the multiple coil heat exchanger.
Figure 8:
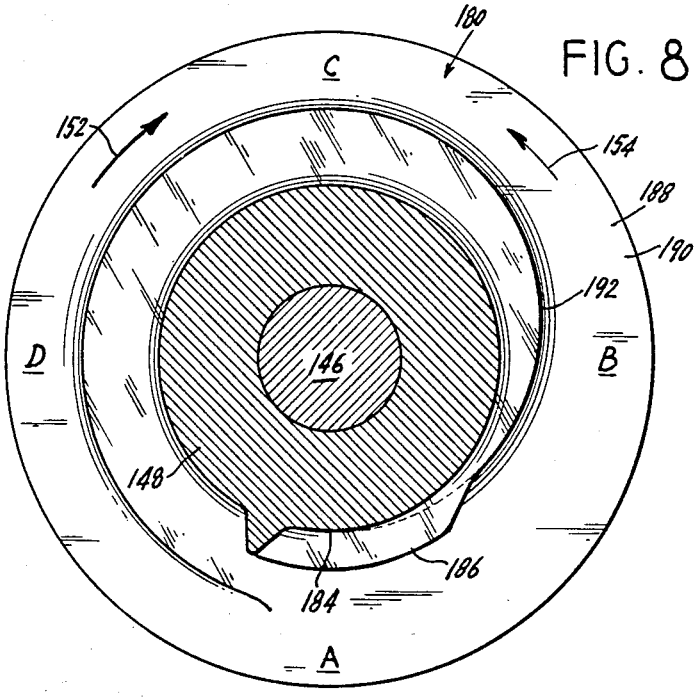
FIG. 8 is a partial section taken along lines 8—8 in FIG. 7 illustrating the coil-reversing plate of the coil-forming die having a first portion which radially extends outward past the radial extent of the spiral-like thread of the coil-forming die and a second portion which axially extends toward the front surface of the coil-forming die; and, FIGS. 9–14 are progressive side elevational views of the rotating coil-forming die included within the coil-forming apparatus of this invention for fabricating the multiple coil heat exchanger according to the continuous coil-forming method of this invention and further illustrating the structural features and arrangement of the coil-reversing plate provided for fabricating the transition segment of the multiple coil heat exchanger.

The illustrative multiple coil heat exchanger, according to this embodiment of this invention is fabricated, by way of one example, using a multiple coil-forming apparatus having a coil-forming die rotatably mounted thereon, as illustrated in FIGS. 6 and 8. The coil-forming die has a continuous spiral thread sized constructed to receive the continuous tube and commencing at one end of the coil-forming die and terminating at the other end at a coil-reversing plate. The coil-reversing plate merges with and is a continuation of the spiral-like thread of the coil-forming die. The coil-reversing plate includes a first circumferential segment which includes a ramp to radially extend the continuous tube outward past the radially extent of the inner tube and a second circumferential segment for axially extending the continuous tube over the last turn of the inner coil.

The multiple coil heat exchanger is fabricated using the coil-forming apparatus of this invention and a continuous coil-forming method, as described with reference to FIGS. 9–14. It is to be understood that the multiple coil heat exchanger, according to this invention, may be fabricated on other coil-forming apparatus other than the illustrated coil-forming apparatus of this invention and according to a method which further departs from the continuous coil-forming method which will be described.

Figure 2:
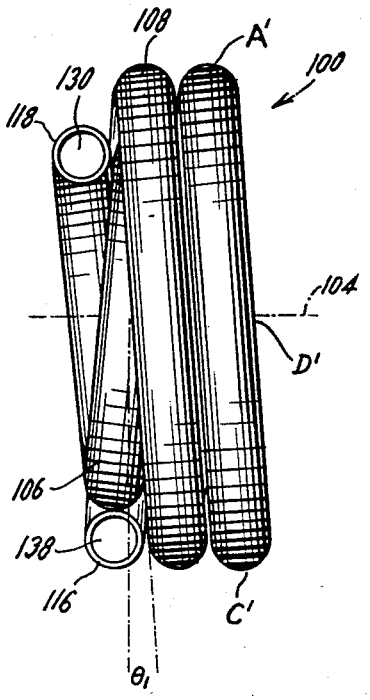
FIG. 2 is a side elevational view of a multiple coil heat exchanger as viewed from the right of FIG. 1 illustrating the outer coil having a pitch in one direction and the inner coil having a pitch in the opposite direction.
Figure 4:
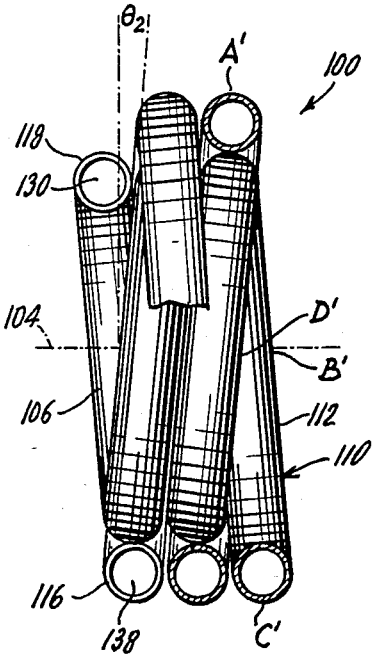
FIG. 4 is a side elevational view of a multiple coil heat exchanger as viewed from the right of FIG. 1 having a portion of the outer coil removed to show a substantial portion of the outer coil removed to show a substantial portion of the inner coil having a pitch in the opposite direction of the outer coil.
Figure 5:
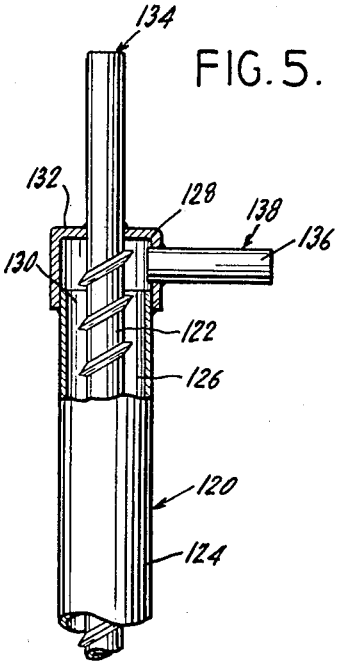
FIG. 5 is a front elevational view of a typical end cap assembly for a concentric tube having a section removed to illustrate the construction and arrangement of the end cap to provide a separate inlet and outlet for a fluid flowing within the inner tube and a fluid flowing within the annular region provided between the outer surface of the inner tube and the inner surface of the outer tube.

Referring specifically to the drawings, there is shown in FIGS. 1–4, a multiple coil heat exchanger constructed according to this invention, generally designated by reference numeral 100. The heat exchanger 100 is formed from a continuous tube 102 spirally coiled about a common axis 104 as shown in FIGS. 2 and 4 to form inner and outer concentric overlapping coils 106, 108.

The inner coil 106 includes a plurality of contiguous turns of substantially equal radius coiled about and spaced along the common axis 104 in a spiral arrangement. The outer coil 108 is likewise formed in a spiral arrangement from the tube 102 of a plurality of continuous turns of substantially equal radius coiled concentrically about and substantially coextensive with the inner coil 106. The outer coil 108 is spaced along the common axis 104 in the opposite direction of the inner coil 106.

Figure 3:
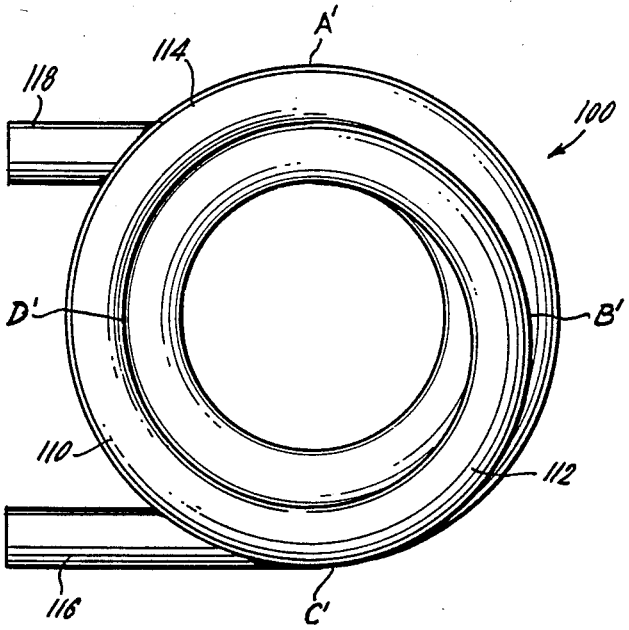
FIG. 3 is a rear elevational view of the multiple coil heat exchanger of FIG. 1 illustrating the continuous joining of the inner coil to the concentric outer coil by a continuous transition segment having a first portion which radially extends outward slightly past the inner coil and a second portion which axially extends over the inner coil towards the inlet and outlet ends of the heat exchanger.

As shown in FIG. 3, the inner and outer coils 106, 108 are joined uninterrupted by a continuous transition segment 110 at the far end of the heat exchanger 100. The transition segment 110 forms a portion of the last turn of the inner coil 106 and a portion of the first turn of the outer coil 108. A first curved portion 112 of the transition segment 110 is of increasing radius of curvation to radially extend the tube 102 slightly past the radial extent of the inner coil 106. The second curved portion 114 is continuous with the first curved portion 112 and extends the tube 102 from its increased radius of curvature axially over the last turn of the inner coil 106 to form the outer coil 108.

As shown in FIGS. 1 and 3, the outer coil 108 includes a straight inlet segment 116 adapted to ingress a heat transfer fluid and the inner coil 106 includes a straight outlet segment 118 adapted to egress the heat transfer fluid. Both the inlet and outlet segments 116, 118 extend tangentially from the respective inner and outer coils 106, 108 and substantially parallel to each other at the rear end of the heat exchanger 100 in a common plane that is transverse to the common axis 104. As illustrated, the inlet and outlet segments 116, 118 terminate within the common plane at substantially the same extended location. As will be further described with reference to the continuous method of fabricating the heat exchanger 100 according to this invention, the inlet and outlet segments 116, 118 may extend in other than parallel relationship to each other.

As shown in FIG. 2, the turns of the outer coil 108 are right handed turns having a pitch angle $\theta_1$ formed between a plane transverse to the common axis 104 and a plane including a turn of the outer coil 108. As shown in FIG. 4, the turns of the inner coil 106 are left handed turns having an opposite pitch angle $\theta_2$ formed between a plane transverse the common axis 104 and a plane including a turn of the inner coil 106. The pitch angles $\theta_1$ and $\theta_2$ are usually selected to be small to provide for the compact construction of the turns of the inner and outer coils 106, 108, but sufficiently large to enable the turns of the inner and outer coils 106, 108 to be formed contiguous and overlapping without excessive deformation of the tube 102 during the continuous coil-forming method according to this invention.

The relative size of the pitch angles $\theta_1$ and $\theta_2$ are generally a function of the diameter of the inner and outer coils 106, 108 and of the diameter of the tube 102. Generally, small pitch angles $\theta_1$, $\theta_2$ are permitted by including a relatively large diameter for the inner and outer coils 106, 108, or a relatively small diameter for the tube 102. In one illustrative embodiment of the multiple coil heat exchanger 100, the pitch angles $\theta_1$, $\theta_2$, were selected to be in the range of approximately 4°-20° and approximately equal to each other.

As thus described, the multiple coil heat exchanger 100 according to this invention, is constructed of a sufficient number of turns of the tube 102 to provide a compact heat exchanger having a high heat transfer density to meet the minimum size requirements and performance criteria of modern refrigeration systems.

The multiple coil heat exchanger 100 may be fabricated from a single continuous tube 102 as shown in FIGS. 1 to 4 or from a multiple concentric tube 120 as shown in FIG. 5. The incorporation of a multiple concentric tube 120 in the multiple coil heat exchanger 100 of this invention results in a heat exchanger 100 having increased heat transfer area to provide overall higher efficiency of the heat exchanger 100. The concentric tube 120 is illustrated to include a contiguous inner corregated tube 122 concentric with a continuous non-corregated outer tube 124. Heat is exchanged between a heat transfer fluid flowing within the inner tube 122 and a heat transfer fluid flowing in the annular region 126 provided between the outer surface of the inner tube 122 and the inner surface of the outer tube 124. The construction of one multiple concentric tube for fabricating a multiple coil heat exchanger according to this invention is described in the aforementioned patent assigned to the same assignee as the present invention.

An end cap assembly 128 which is illustrated as being secured over the opening 130 located at each terminal end of the outer tube 124 conveniently provides an inlet and outlet to the inner tube 122 and the annular region 126. The inner tube 122 extends through the top portion 132 of the end cap assembly 128 to provide inlet/outlet port 134 for the inner tube 122. A short tube segment 136 extending through a side portion of the end cap assembly 128 to provide an inlet/outlet port 138 for the annular region 126.

Figure 7:
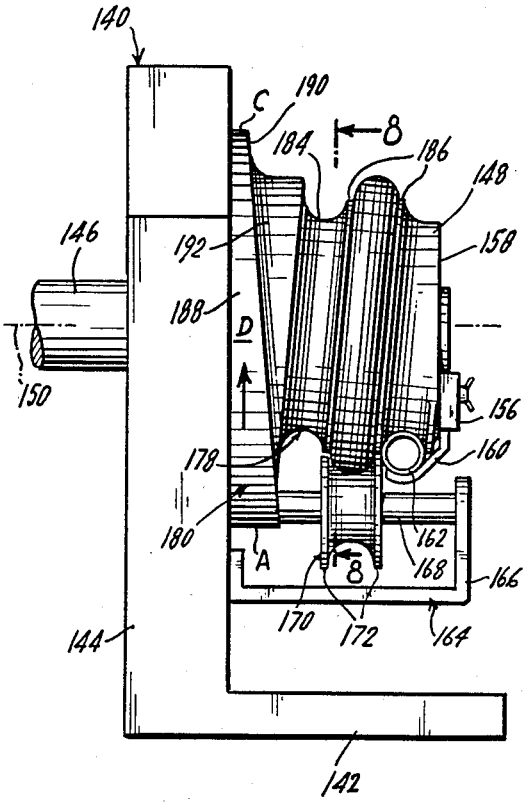
FIG. 7 is a side elevational view of the coil-forming apparatus as viewed from the left of FIG. 6 illustrating the coil-forming die rotatably mounted on a supporting shaft extending through an upstanding frame and having a spiral-like thread terminating at a coil-reversing plate adjacent the upstanding frame.

As shown in FIGS. 6 and 7, a coil-forming apparatus 140 according to this invention, is illustrated for fabricating a multiple coil heat exchanger 100 as previously described. In general, the coil-forming apparatus 140 includes a base plate 142 and an upstanding frame 144 through which a horizontal supporting shaft 146 extends which is rotatably mounted by appropriate bearings (not shown) on the frame 144. Attached to the supporting shaft 146 is a coil-forming die 148 rotatably mounted for rotation about the central axis 150 by suitable drive means (not shown), such as an electric motor. The coil-forming die 148 is adapted for rotation in either a coil-forming direction as indicated by arrow 152 or a coil-releasing directon as indicated by the arrow 154 by the drive means. The coil-forming die has a continuous spiral-like thread 178 commencing at one end of the die and terminating at a coil-reversing plate 180 located adjacent the upstanding frame 144 at the other end of the coil-forming die.

As shown in FIG. 7, the coil-forming die 148 includes a continuous spiraling left handed thread 178 commencing at the front surface 158 and terminating at a progressive circumferentially extending coil reversing plate 180 at the rear portion of the coil-forming die adjacent the upstanding frame 144. The thread 178 is constructed to include a root 184 and adjacent thread side walls 186. The thread side walls 186 and root 184 are constructed and arranged to partially circumscribe tube 102. The circumscribing of the tube 102 provides lateral circumferential support for the tube 102 during the coil-forming operation, thereby preventing the tube 102 from flattening. The pitch angle $\theta_2$ of the inner coil 106 is determined by the corresponding pitch angle of the thread 178. In one illustrative embodiment of the multiple coil heat exchanger according to this invention, the root 184 and the thread side walls 186 circumscribe the tube 102 slightly above the center axis of the tube 102.

The coil-reversing plate 180, as shown generally in FIGS. 7 and 8, is constructed of a circular wedge shaped disc 188 positioned about a central axis 150 at the rear portion of the coil-forming die 148. The disc 188 includes a circular planar wedging surface 190 which supports a coaxial, radially extending ramp 192 of varying width. The construction of the coil-reversing plate 180 is best shown with reference to FIGS. 9 and 11. The coil-reversing plate 180 is generally divided into two continuous 180° circumferential segments designated ABC and CDA. The first circumferential segment ABC is shown in FIG. 9. The root 184 and side wall 186 of the last thread at the rear portion of the coil-forming die 148 merges radially with the ramp 192. The ramp 192 of the first circumferential segment ABC is constructed of uniform width to accommodate the diameter of the tube 102.

The ramp 192 is bound on the right side by the wedging surface 190 which provides a supporting wall for the tube 102. The ramp 192 and wedging surface 190 within the first circumferential segment ABC provide a pseudo-thread for the tube 102 having a pitch angle substantially equal to the pitch angle $\theta_2$ of the inner coil 106. The ramp 192 starts with a diameter equal to the inside diameter of the inner coil 102 at A. As the ramp 192 circumferentially progresses through the first circumferential segment ABC, the ramp 192 continuously and gradually extends radially outward from the central axis 50 until the diameter of the ramp 192 is slightly greater than the inside diameter of the outer coil 108 at C.

The second circumferential segment CDA of the coil-reversing plate 180 is shown in FIG. 11. The ramp 192 through the second circumferential segment CDA is constructed to retain its radial extended position from the common axis 150 corresponding to slightly greater than the inside diameter of the outer coil 108. The ramp 192 gradually decreases in width from its initial width corresponding to the diameter of tube 102 at C until the width of the ramp 192 vanishes upon merging with the wedging surface 190 at A. The ramp 192 with the second circumferential segment CDA is likewise bound on the right side by the wedging surface 190 which provides a supporting wall for the tube 102. The ramp 192 and the wedging surface 190 through the second circumferential segment CDA provide a pseudo-thread for the tube 102 having a pitch angle substantially equal to the pitch angle $\theta_1$ of the outer coil 108.

An adjustable clamp 156 is mounted to the front surface 158 of the coil-forming die 148. The adjustable clamp 156 includes a hook portion 160 to engage the free end 162 of the tube 102 to secure the free end 160 to the coil-forming die 148 during the continuous coil-forming operation. The upstanding frame 144 has transversely mounted thereto an adjustable roller support assembly 164 by a horizontal U-shaped bracket 166 through which a rod 168 extends parallel therewith. A roller support 170 having a radially extending lip portion 172 at each end thereof is slidably mounted on the rod 168 for movement parallel to the central axis 150 for continuous support of the tube 102 as it is coiled upon the coil-forming die 148 in accordance with the coil-forming method of this invention.

Attached to the upper portion of the upstanding frame 144 is an arcuate scale 174 partially circumscribing the coil forming die 148. The scale 174 includes a plurality of scale marks 176 which are used during the fabrication of the multiple coil heat exchanger 100 to locate the precise position of the inlet and outlet segments 116, 118 relative to each other as will be described hereinafter.

The operation of the coil-forming apparatus 140 will be best understood by next describing the continuous coil-forming method of this invention for fabricating a compact multiple coil heat exchanger 100 having a high heat transfer density using such apparatus 140. Initially referring to FIG. 6, a length of continuous tube 102 is positioned between lip portions 172 of the roller support 170 while the free end 162 is firmly secured within the first thread of the coil-forming die 148 at a coil-starting position by the hook portion 160 of the adjustable clamp 156. The free end 162 extends sufficiently beyond the adjustable clamp 156 to provide the outlet segment 118 of the inner coil 106. The initial rotational position of the coil-forming die 148 is observed with reference to the scale marks 176 of the arcuate scale 174. The precise position of the inlet and outlet segments 116, 118 relative to each other can be readily determined by terminating the continuous coil-forming operation when the final rotational position of the coil-forming die 148 is at the appropriate selected scale mark 176 of the arcuate scale 174.

Next, referring to FIGS. 9 through 14, the coiling of the tube 102 about the coil-forming die 148 in fabricating the inner coil 106, the transition segment 110 and the outer coil 108 of the heat exchanger 100 is progressively shown. Referring specifically to FIG. 9, the tube 102 having been secured within the first thread of the coil-forming die 148 by hook portion 160 is rotated about the central axis 150 in the direction of the arrow 194. As the coil-forming die 148 is continuously rotated, the tube 102 is spirally coiled within the thread 178 forming two contiguous turns of the inner coil 106 of equal radius and having a pitch angle $\theta_2$. The tube 102 is now positioned at the start of the coil-reversing plate 180 where the last thread of the coil-forming die 148 merges with the ramp 192 at the first circumferential segment ABC.

The transition segment 110 of the heat exchanger 100 is fabricated by the coil-reversing plate 180 by continuously rotating the coil-forming die 148 through 360° as shown in FIG. 10 through FIG. 13. Referring to FIG. 10, as the coil-forming die 149 is rotated in the direction of arrow 194, the ramp 192 in the first circumferential segment ABC gradually increases the radius of curvature of the tube 102 relative to the last turn 196 of the inner coil 106. As shown in FIG. 11, the rotation of the coil-reversing plate 180 through the first 180°, continuously and gradually extends radially outward the tube 102 from the center axis 150 until the radial extended position of the tube 102 is slightly greater than the inside diameter of the outer coil 108 at C to prevent possible binding between the inner and outer coils 106, 108. The engagement of the tube 102 by the first circumferential segment ABC of the coil-reversing plate 180 forms the first curved portion 112 of the transition segment 110 to having a pitch angle substantially equal to the pitch angle $\theta_2$ of the inner coil 106.

The second curved portion 114 of the transition segment 110 is fabricated by the second circumferential segment CDA of the coil-reversing plate 180 by the continued rotation of the coil-reversing plate 180 through a second 180° as shown in FIGS. 11 through 13. Referring to FIG. 11, the tube 102 is now positioned at C corresponding to the start of the second circumferential segment CDA of the coil-reversing plate 180. As heretofore described, the ramp 192 and wedging surface 190 provide a pseudo-thread for the tube 102 having a pitch angle substantially equal to the pitch angle $\theta_1$ of the outer coil 108.

As shown in FIGS. 12 and 13, the second curved portion 114 of the transition segment 110 is fabricated by rotating the coil-forming die 148 in the direction of the arrow 194 through a second 180°. As the tube 102 is engaged by the second circumferential segment CDA through the second 180° of rotation of the coil-forming die 148, the pitch angle of the tube 102 is changed from the pitch angle $\theta_2$ of the inner coil 106 to the pitch angle $\theta_1$ of the outer coil 108. The combined effect of the decreasing width of the ramp 192 in the second circumferential segment CDA and the changing of the pitch angle $\theta_2$ of the tube 102 to the pitch angle $\theta_1$ of the outer coil 108, causes the tube 102 to be progressively and axially extended over the last turn 196 of the inner coil 106 as shown in FIGS. 12 and 13. The tube 102 having been axially extended over the last turn 196 over the inner coil 106 now corresponds to a portion of the first turn of the outer coil 108 having a pitch angle $\theta_1$.

As shown in FIG. 14, the outer coil 108 is formed from the tube 102 by further rotating the coil-forming die 148 in the direction of the arrow 194. As the coil-forming die 148 is rotated, the tube 102 is coiled about the inner coil 106 to form a plurality of contiguous turns of equal radius coiled concentrically about and substantially coextensive with the inner coil 106 in a spiral arrangement. The coil-forming operation is terminated when the rotational position of the coil-forming die 148 corresponds to the selected scale mark 176 of the arcuate scale 174 such that the inlet and outlet segments 116, 118 are located at their desired respective locations. The completed multiple coil heat exchanger 100 is removed from the coil-forming die 148 by rotating the coil-forming die in the coil-releasing direction 154 as shown in FIG. 6 while restraining the completed heat exchanger 100 from rotation.

The ramp 192 of the coil-reversing plate 180 within the first circumferential segment ABC has been described as gradually extending radially outward until the diameter of the ramp 192 is slightly greater than the inside diameter of the outer coil 108. The radially extending portion of the ramp 192 can be constructed to circumscribe a greater or lesser portion of the coil-reversing plate 180 than 180° to provide the first circumferential segment ABC. When the radially extending outward portion of the ramp 192 circumscribes greater than 180° of the coil-reversing plate 180, the circumferential segment ABC provides a more gradual radial bending of the first curved portion 112 of the transition segment 110 to provide easy removal of the heat exchanger 100 from the coil-forming die 148.

The second circumferential segment CDA of the coil-reversing plate 180 has been described to progressively axially extend the tube 102 over the last turn 196 of the inner coil 106 as shown in FIGS. 12 and 13. The second circumferential segment CDA of the coil-reversing plate 180 may also be constructed to circumscribe greater or less than 180° of the coil-reversing plate 180. Changing the extent of the second circumferential segment CDA only requires that there be no undue interference with the last turn 196 of the inner coil 106 as the second circumferential segment CDA axially extends the tube 102 over the last turn 196. By axially extending the tube 102 over the inner coil 106 when the transition segment 110 has been extended radially outward to slightly greater than the outside diameter of the inner coil 106, the outer coil 108 may be fabricated without exerting undue compressive forces on the inner coil 106 which would otherwise tend to further flatten the inner coil 106 as well as inhibit the removing of the heat exchanger 100 from the coil-forming die 148 upon completion.

With the coil-forming apparatus as thus described according to this invention, a multiple coil heat exchanger can be formed into a compact configuration of minimum size while having a high heat transfer density as measured in BTU's/hour/surface area. The heat transfer capacity of the multiple coil heat exchanger may be further increased with a minimum increase in size by coiling on an additional layer of coils concentrically about the outer coil 108. This can be achieved by attaching to the front surface 158 of the coil-forming die 148, after the inner coil 106 has been started, an additional coil-reversing plate of the type previously described. The coil-reversing plate radially extends the outer coil 108 to a radially extended position slightly greater than the outside diameter of the outer coil 108 and axially extends tube 102 over the outer coil 108 to form a concentric and coextensive third coil while continuing the rotation of the coil-forming die 148.

The pitch diameter of the coil-forming die 148 required for coiling a tube into a multiple coil heat exchanger 100 requires taking several factors into consideration. For example, one factor is the minimum bending radius for the tube 102 which generally should be larger than some multiple of the diameter of the tube 102 to avoid damage to the tube, such as excessive tube distortion and cracks. A second consideration is that as the diameter of the coil is decreased, there is a corresponding reduction in the length of the multiple coil heat exchanger 100 that can be formed from a predetermined length of tube 102 for a specified number of turns. In one embodiment, a coil-forming die 148 for forming a concentric heat exchanger 100 from a tube 102 having a $1\frac{1}{2}$ inch outer diameter has a pitch diameter of about $9\frac{3}{4}$ inches.

The extent that thread sidewalls 186 circumscribe the tube 102 is a function of the amount of positive lateral support needed to prevent flattening of the tube 102. For example, for a $1\frac{1}{2}$ inch outer diameter tube 102, a circumscribing of the tube 102 by approximately 1/16 of an inch above the center line of the tube 102 is usually found sufficient. When the pitch diameter and the extent of positive lateral support are selected as in the aforementioned examples, the inner coil 106 can be coiled with a sufficiently large bending radius to avoid excessive distortion or flattening. The coil-forming die 148 can be made from steel with a numerically controlled machining tool or from an aluminum sand casting through use of a wooden pattern and a suitable sand mold.

In a multiple coil-forming apparatus according to this invention, a multiple coil concentric heat exchanger can be fabricated from both a thin wall, about 0.048 inches, and a heavy wall, about 0.065–0.109 inches, tube 102. In modern refrigeration systems, a typical diameter for a tube 102 used to fabricate a multiple coil heat exchanger 100 may be in the order of $1\frac{1}{2}$ inches, though different sizes can be accommodated according to the coil-forming apparatus and continuous coil-forming method of this invention.

The continuous outer tube 124 of a multiple concentric tube 120 is preferably formed of carbon steel which, after all mechanical working, is fully annealed and leak tested for cracks and faulty welds. The coil-forming die 148 described herein is shown as cylindrical having a uniform diameter although other shapes may be employed depending upon the desired configuration of the multiple coil heat exchanger 100. For example, the inner and outer coils can be fabricated in the shape of a cone having decreasing diameters along their length. With a different shaped coil-forming die, however, a collapsing die may be necessary to release the completed multiple coil heat exchanger 100 therefrom.

In a heat exchanger in accordance with this invention, a high density heat exchange capacity is obtained. The heat exchanger is made of a heat exchange tube which has been bent into a coiled structure formed of an inner coil composed of a plurality of like-sized turns and an outer coil also composed of plurality of like-sized turns, but closely wrapped about the inner coil. The inner and outer coils are joined by a contiguous transition segment, which, starting at one end of the inner coil, is radially extended relative to the inner coil and axially wedged over the inner coil to commence the second outer coil.

The term "coil" as used herein means a plurality of turns or loops of a heat exchange tube around an axis where the turns are spaced along the axis and are generally of the same size. A multiple coil structure thus means at least a pair of such coils, one wrapped over the other, with each coil formed of generally like-sized turns.

A heat exchanger in accordance with this invention is formed by wrapping a longitudinal heat exchange tube over a die provided with a screw thread sized to at least partially circumferentially support the tube. The die is mounted for rotation about an axis so that upon die rotation, the heat exchange tube is wound up on the thread of the die to form first an inner coil.

At an axial end of the die is a circumferential coil reversing surface in alignment with the die thread. This surface has a first portion which spirals outwardly so that the heat exchange tube is radially bent above the turns of the inner coil. The coil-reversing surface has a second portion which axially ramps towards the other axial end of the die to direct the previously radially outwardly bent heat exchange tube over the inner coil and thus commence a second or outer coil.

With an apparatus in accordance with this invention, a heat exchanger in accordance with this invention can be formed and completed in a single step of continuous rotation of the die in one direction. The multiple coil structure is compact and yields a high density of heat exchange capacity. The process for making a heat exchanger in accordance with the invention advantageously reduces mechanical working of the heat exchange tube so that a more consistent quality, such as more uniform diameter of the bent tube, in a shorter time is obtained.

The invention herein has been described with reference to particular embodiments, it is to be understood that these embodiments are merely illustrative of the principles and application of this invention. Thus, it is to be understood that numerous modifications may be made in the illustrative embodiments and other arrangements may be devised without departing from the spirit and scope of this invention.

What is claimed is:

1. A method of forming a heat exchanger from a generally straight longitudinal heat exchange tube enclosing an inner tube comprising the steps of mounting one end of the heat exchanger tube to one axial end of a threaded rotatable die having a screw thread with a root sized to receive said heat exchange tube at said one axial end with at least partial circumferential support therefor; rotating said die in one direction to wind the heat exchange tube onto the thread of the die to form a plurality of turns of an inner coil of said heat exchange tube; upon completion of said inner coil continuing to rotate said die in said one direction while wedging said heat exchange tube radially outwardly and subsequently axially towards said one axial end of the die to commence a first turn of a second coil concentric with and over the inner coil; and, continuing to rotate the die in said one direction to bend said heat exchange tube and form said second coils with a plurality of turns.

* * * * *